US006901368B1

(12) United States Patent
Ono

(10) Patent No.: US 6,901,368 B1
(45) Date of Patent: May 31, 2005

(54) VOICE TRANSCEIVER WHICH ELIMINATES UNDERFLOW AND OVERFLOW FROM THE SPEAKER OUTPUT BUFFER

(75) Inventor: Yoshihiro Ono, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/315,058

(22) Filed: May 20, 1999

(30) Foreign Application Priority Data

May 26, 1998 (JP) ..... 10-144734

(51) Int. Cl.[7] ..... G10L 19/00
(52) U.S. Cl. ..... 704/500; 704/504
(58) Field of Search ..... 704/500–504; 367/87, 117, 903; 455/5.1, 73, 91, 570

(56) References Cited

U.S. PATENT DOCUMENTS

| | | | | | |
|---|---|---|---|---|---|
| 4,520,499 | A | * | 5/1985 | Montlick et al. | 704/266 |
| 4,618,936 | A | * | 10/1986 | Shiono | 704/258 |
| 4,912,758 | A | * | 3/1990 | Arbel | 379/388 |
| 4,920,534 | A | * | 4/1990 | Adelmann et al. | 370/94.1 |
| 4,993,022 | A | * | 2/1991 | Kondo et al. | 370/462 |
| 5,483,528 | A | * | 1/1996 | Christensen | 370/62 |
| 5,526,353 | A | * | 6/1996 | Henley et al. | 370/60.1 |
| 5,617,423 | A | * | 4/1997 | Li et al. | 370/426 |
| 5,659,698 | A | * | 8/1997 | Weng et al. | 395/421.1 |
| 5,699,481 | A | * | 12/1997 | Shlomot et al. | 704/228 |
| 5,812,534 | A | * | 9/1998 | Davis et al. | 370/260 |
| 5,940,479 | A | * | 8/1999 | Guy et al. | 379/93.01 |
| 5,970,137 | A | * | 10/1999 | Le Damany et al. | 379/388 |
| 6,011,806 | A | * | 1/2000 | Herring | 370/494 |

FOREIGN PATENT DOCUMENTS

JP 61-62287 3/1986
JP 7-245593 9/1995

OTHER PUBLICATIONS

Witte et al, "Multipurpose Audio Signal Compander", 1993, IEEE, pp. 260–265.*

Japanese Office Action, dated Apr. 10, 2001, with English language translation of Japanese Examiner's comments.

* cited by examiner

*Primary Examiner*—Susan McFadden
*Assistant Examiner*—Michael N. Opsasnick
(74) *Attorney, Agent, or Firm*—Whitham, Curtis & Christofferson, PC

(57) ABSTRACT

According to the present invention, a voice transceiver is provided which is characterized in comprising: an input mechanism for inputting compressed voice codes of analog data; an expansion unit for digitalizing the compressed voice codes, and expanding and outputting digital voice data; a buffer for storing the digital voice data; a detection unit for detecting the quantity of data of the digital voice data stored in the buffer, and outputting a detection signal as the detection result; a converter for converting the digital voice data into analog voice data based on a detection signal; and a speaker for emitting the analog voice data into the air. In addition, an insertion/disposal control unit monitors the remaining data amount of the digital voice data of an SP output buffer, such that when the digital voice data within the buffer falls below a first threshold value, a dummy voice code is supplied to a voice decoder; on the other hand, when the digital voice data within the buffer exceeds a second threshold value, the insertion/disposal control unit discards the digital voice data to be outputted to the voice decoder. As a result, the detection performance, in the case when the transmission data is disrupted, is improved; the reliability of the voice data reception is increased; the voice reception quality is improved; and the output from the speaker is controlled to ensure a smooth output voice.

3 Claims, 3 Drawing Sheets

VOICE TRANSCEIVER WHICH ELIMINATES UNDERFLOW AND OVERFLOW FROM THE SPEAKER OUTPUT BUFFER

BACKGROUND OF THE INVENTION

1. Field of the Invention

The present invention relates to a voice transceiver for use in voice transmission by means of digital voice signals which utilize compressed voice coding.

This application is based on Patent Application No. Hei 10-144734 filed in Japan.

2. Relevant Art

FIG. 3 is a block diagram showing the structure of a conventional voice transceiver. In the figure, a decoding code buffer 301 receives compressed voice codes from a circuit (not shown in the figure), and stores these codes into an internal memory. A voice decoder 401 then digitalizes and expands these compressed voice codes stored in the memory of the decoding code buffer 301 into digital voice data.

An SP (speaker) output buffer 501 inputs and stores the voice data expanded by means of the voice decoder 401. D/A converter 601 converts the digital voice data stored in the SP output buffer 501 into an analog voice signal. An amplifier 701 amplifies the analog signal by a predetermined magnitude (amplification), and a speaker 801 then emits the amplified analog voice signal into the air.

In addition, a microphone 802 (hereinafter also referred to as "mic") collects a transmitted voice and converts it into an electronic signal. The microphone 802 then converts the aforementioned conversion result into an analog voice input signal. An amplifier 702 amplifies the analog voice input signal to be inputted by a predetermined magnitude (amplification). A/D converter 602 then converts the analog voice input signal into a digital voice input signal. MIC (microphone) input buffer 502 subsequently stores this digital voice input signal.

A voice encoder 402 encodes the digital voice input signal stored in the MIC input buffer 502, and outputs a compressed voice code as a result of the encoding. A compression code buffer 302 then stores the compressed voice code inputted from the voice encoder 402.

In the following, an operation of the voice transceiver according to aforementioned conventional example will be described.

For example, the decoding code buffer 301 temporarily stores the compressed voice code inputted from a communication circuit (not shown in the figures) into an internal memory portion. Subsequently, using the storage of the compressed voice code into decoding code buffer 301 as a trigger, the voice decoder 401 begins processing by expanding the compressed voice code stored in the memory portion of the decoding code buffer 301, and generating digitalized digital voice data.

In this manner, the generated voice data is inputted and written into the SP output buffer 501. On the other hand, a voice encoder 402 detects the writing of the digital voice data required for encoding one frame in MIC input buffer 502. The voice encoder 402 then commences operation by compressing the digital voice data, and generating a compressed voice code.

Following completion of this operation, the voice encoder 402 outputs the generated compressed voice code to a compression code buffer 302. This compression code buffer 302 then stores the inputted compressed voice code. In this manner, the compression code buffer 302 transmits the compressed voice code stored therein to the communication circuit side (not shown in the figures).

Furthermore, the right side of the operation from the D/A converter 601 and A/D converter 602, respectively shown in FIG. 3, is performed during a fixed clock cycle by means of hardware. In other words, the digital voice data of SP output buffer 501 is outputted one sample at a time when necessary, and converted into an analog voice signal by means of D/A converter 601. In addition, at the same time, the analog voice signal inputted from the microphone 802 is sampled when necessary during a fixed cycle, converted by A/D converter 602 into a voice signal, and written into MIC input buffer 502 as necessary.

However, in the case when the aforementioned voice transceiver is operated in an environment in which the digital voice input signal, which serves as the reception decoding code, is not smoothly and regularly supplied, problems arise such as the generation of interruptions in the output voice from speaker 801, leading to an extreme degradation of the quality of the voice reception (receiving voice quality).

For example, in a personal computer, the supply of a smooth and regular reception signal code cannot be guaranteed by controlling the processing assignment of the processor, by means of processing of the aforementioned voice transceiver (using the same processor) and simultaneously operating an optional user software. As a result, as described above, extreme degradation of the voice reception quality results, when embodying the processing of the aforementioned voice transceiver as software of a personal computer, using a voice transmitter, desktop conference system or the like, which utilizes a personal computer.

In addition, in a multi-media transmission terminal, besides voice codes, other data such as images and the like are mixed therein and transmitted. As a result, when the transmission data in a communication circuit is disrupted, it is not possible to specify the disrupted data as voice data or otherwise, and thus a regular and unimpaired supply of reception decoding codes cannot be guaranteed. Consequently, the quality of voice reception is notably degraded even in the voice transmission processing portion of a multi-media transmission terminal.

Here, enlargement of the SP output buffer and absorption of the jitter from the output voice may be considered, as an example of a method for avoiding the degradation of the voice reception quality occurring in a voice transmission processing portion of a multimedia transmission terminal. However, an increase in the SP output buffer causes an increase in the shift distance over which the digital voice input signal must pass from the point of input to the point of output. This aspect, in turn, leads to a delay in the voice, and is hence undesirable from a practical standpoint.

In addition, the jitter amount is statistically distributed. As a result, there is a distinct disadvantage in that it is not possible to calculate an absolute value with respect to the optimal amount for enlarging the SP output buffer, as this value changes depending on various conditions.

Consequently, as a result of the reception voice signal not being supplied after monitoring the remaining data of the SP output buffer, the conventional technology poses problems in that in an environment in which the supply of the reception decoding code is performed in a "burst transmission" manner, when the supply of the receiving decoding code is interrupted, or alternatively when the supply of the receiving decoding code is continued after such an interruption, the SP output voice is similarly interrupted and non-continuous, thereby leading to extreme degradation of the voice reception quality.

SUMMARY OF THE INVENTION

In consideration of the aforementioned, it is an object of the present invention to provide a voice transceiver capable of improving the detection performance in the case when the transmission data is disrupted, increasing the reliability of the voice data reception, improving the voice reception quality, and exerting control such that the output voice from the speaker remains smooth and uninterrupted.

In order to achieve the aforementioned, the present invention provides, according to a first aspect, a voice transceiver characterized in comprising:

- an input means for inputting compressed voice codes of analog data;
- an expansion means for digitalizing said compressed voice codes, and expanding and outputting said digital voice data;
- a buffer means for storing said digital voice data;
- a detection means for detecting the quantity of data in said digital voice data stored in said buffer, and outputting a detection signal as a detection result;
- a conversion means for converting said digital voice data into analog voice data based on said detection signal; and
- a speaker means for emitting said analog voice data into the air.

Furthermore, according to a second aspect of the present invention, a voice transceiver is provided which is characterized in further comprising a data control means for controlling the output of said digital voice data to said conversion means, based on said detection signal; wherein, said data control means outputs a dummy code to said expansion means, in the case when said digital voice data stored in said buffer means is less than a required amount for play back; in contrast, in the case when said buffer means approaches an overflow amount, said data control means does not allow the output of said digital voice data to said conversion means.

Moreover, according to a third aspect of the present invention, a voice transceiver is provided, wherein when said dummy code is inputted into said expansion means, said expansion means outputs digital voice data in which the strength of said compressed voice code inputted immediately prior to said dummy signal is reduced.

In addition, according to a fourth aspect of the present invention, a voice transceiver is provided which is characterized in further comprising:

- a microphone means for inputting voice data;
- a second conversion means for converting said voice data into a digital signal, and outputting this conversion result as other digital voice data; and
- an echo component removal means for removing the echo component contained in said other digital voice data.

The voice transceiver according to the present invention possesses a means for inserting a dummy code into the decoding code buffer 301 when the remaining data amount of the digital voice data stored in the SP output buffer 501 becomes small, and a means for discarding the output voice of voice decoder 401 when the remaining data amount of the digital voice data stored in the SP output buffer 501 becomes large (denoted by reference numerals 100 and 200 in FIG. 2).

As a result, according to the voice transceiver of the present invention, the voice data is controlled such that underflow of the SP output buffer 501 does not occur, and thus, the speaker output voice remains continuous (i.e., such that a non-continuous speaker output voice does not occur).

In addition, according to the voice transceiver of the present invention, the voice data is also controlled such that overflow of the SP output buffer 501 does not occur, and thus accumulation of delays in the speaker output voice, from the time of input from the transmission source terminal similarly do not occur.

DESCRIPTION OF THE PREFERRED EMBODIMENTS OF THE INVENTION

Figure 1:
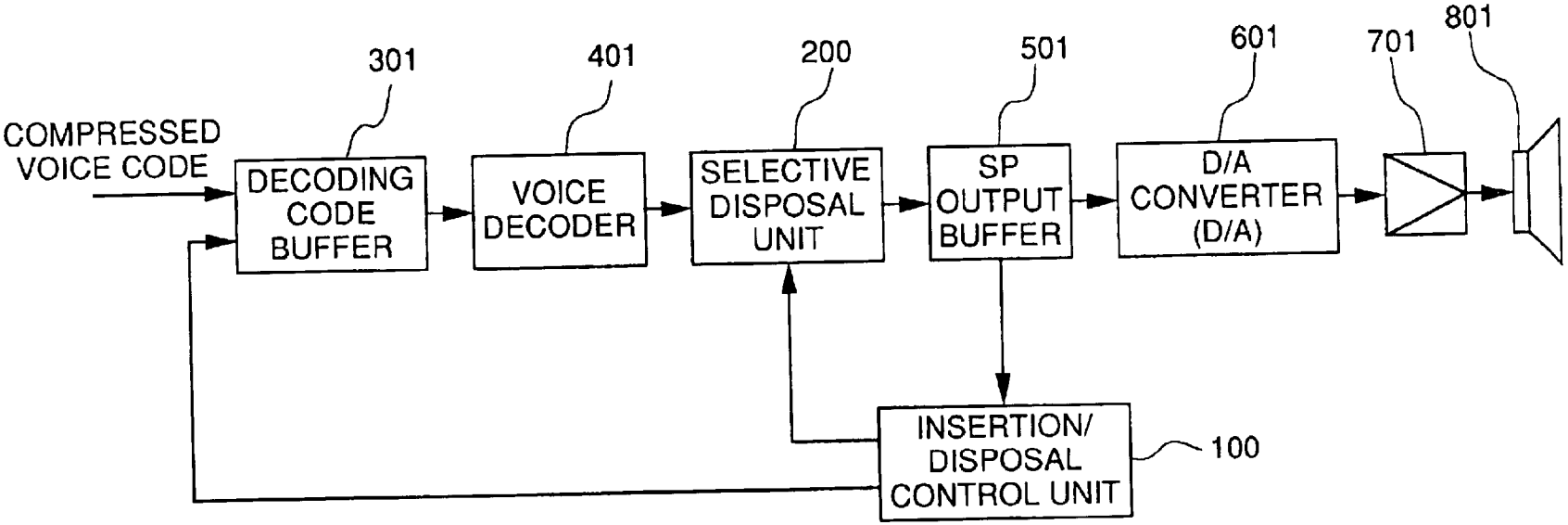
FIG. 1 is a block diagram showing the structure of a voice transceiver according to a first embodiment of the present invention.

In the following, the embodiments of the present invention will be described in detail with reference to the figures. FIG. 1 is a block diagram showing the structure of a voice transceiver according to a first embodiment of the present invention. The structure of the transmitting side of the voice transceiver according to this first embodiment, however, is similar to that of the conventional example, and hence its description will be omitted.

In the figure, a decoding code buffer 301 is provided which receives and stores a compressed voice code received from the circuit side (not shown in the figures). A voice decoder 401 is also provided which expands the compressed voice code of the aforementioned decoding code buffer 301 into digitalized digital voice data. A selective disposal unit 200 selectively discards digital voice data inputted from this voice decoder 401.

SP output buffer 501 stores the digital voice data expanded by means of the voice decoder 401 but not discarded by means of the selective disposal unit 200. an insertion/disposal control unit 100 monitors the remaining data amount of the digital voice data stored in SP output buffer 501. In addition, the insertion/disposal control unit 100 outputs both dummy compression code to the decoding code buffer 301, and a discard request signal to the selective disposal unit 200.

D/A converter 601 converts voice data inputted from SP output buffer 501 into an analog voice signal, and outputs this signal to an amplifier 701. This amplifier 701 amplifies the analog voice signal inputted from D/A converter 601, and outputs the amplified signal to a speaker 801. Subsequently, the speaker 801 emits the amplified analog voice signal inputted from the amplifier 701 into the surrounding air.

In the following, an operational example of the voice transceiver according to the aforementioned first embodiment will be described with reference to FIG. 1.

For example, when a compressed voice code is received from the communication circuit side (not shown in the figures), the decoding code buffer 301 temporarily stores the inputted compressed voice code into an internal memory portion. Using the writing of the compressed voice code into the aforementioned decoding code buffer 301 as a trigger, the voice decoder 401 then expands the compressed voice code stored in the memory portion of decoding code buffer 301, and generates digitalized digital voice data.

Subsequently, the voice decoder 401 outputs the generated digital voice data to the selective disposal unit 200. If the selective disposal unit 200 has not received a discard request from insertion/disposal control unit 100, then the selective disposal unit 200 writes the supplied digital voice data into SP output buffer 501.

On the other hand, if the selective disposal unit 200 has received a discard request from insertion/disposal control unit 100, then the corresponding digital voice data supplied thereto is discarded, and this digital voice data is not written into SP output buffer 501.

Subsequently, the insertion/disposal control unit 100 monitors the remaining data amount of the digital voice data stored in SP output buffer 501, and when this amount falls below a previously set first threshold value, outputs a dummy voice code to the decoding code buffer 301. This first threshold value represents the lower limit (value) of the data amount stored in SP output buffer 501 at which interruption of the output voice does not occur in the speaker 801.

Thereafter, the supply of the dummy voice code serves as a trigger by means of which the operation for generating the aforementioned SP output voice is started. The voice data accumulates in SP output buffer 501 until the data amount stored in SP output buffer 501 exceeds the aforementioned first threshold value.

On the other hand, the insertion/disposal control unit 100 monitors the remaining data in SP output buffer 501, and when the remaining data amount exceeds a second threshold value, the insertion/disposal control unit 100 issues a discard request to the selective disposal unit 200. Subsequently, the selective disposal unit 200 conducts the discard (disposal) processing of the digital voice data with regard to which it has received a discard request, wherein the supply of voice data is halted until the data amount returns to below the previously set, second threshold value of SP output buffer 501. This second threshold value represents the upper limit (value) of the data amount which is capable of being stored in SP output buffer 501.

In the following, an applied example based on the first embodiment of the present invention will be described. According to this applied example, a voice transceiver is provided in which the voice codec (voice encoder 402 and decoder 401) conforms to the recommendations of the ITU-T (Internadonal Telecommunication Union) G.723.1. The structure of the applied example is achieved by means of a voice decoder in which the voice decoder 401 shown in FIG. 1 of the first embodiment conforms to ITU-T G.723.1. Thus, numeral 401 in the same figure may be replaced by a voice decoder 401 which conforms to ITU-T G.723.1, which will be described hereafter.

In the following, the operation of the applied example will be described. Initially, upon receiving a voice code conforming to ITU-T G.723.1 from the communication circuit side (not shown in the figure), the decoding code buffer 301 temporarily stores a compressed voice code into an internal memory portion therein. Using the writing of the compressed voice code conforming to ITU-T G.723.1 into the decoding code buffer 301 as a trigger, the voice decoder 401 conforming to ITU-T G.723.1 expands the compressed voice code within the decoding code buffer 301, and generates digitalized digital voice data.

The voice codec conforming to ITU-T G.723.1 is a codec which compresses/decodes 30 msec (240 samples using 16 bit data sampled at 8 kHz) digital voice data as one frame. Consequently, the voice decoder 401 conforming to ITU-T G.723.1 outputs a voice data frame of 30 msec.

The generated voice data frame is then supplied to the selective disposal unit 200. If selective disposal unit 200 has not received a discard request from the insertion/disposal control unit 100, then the supplied voice data frame is written into SP output buffer 501. On the other hand, if selective disposal unit 200 has received a discard request from the insertion/disposal control unit 100, then the supplied voice data frame is discarded without being written into SP output buffer 501.

For example, in the case when the remaining data amount of SP output buffer 501 drops below a first threshold value, the insertion/disposal control unit 100 supplies, at this time, a dummy voice code to the decoding code buffer 301. The dummy voice code supplied in this manner uses a CRC (Cyclic Redundancy Check) error signal supplied at the time when the code is disrupted at the communication circuit.

Subsequently, using the writing of the dummy voice code into the decoding code buffer 301 as a trigger, the voice decoder 401 conforming to ITU-T G.723.1 performs the decoding process once again. Once the CRC error signal is inputted, the voice decoder 401 conforming to ITU-T G.723.1 generates digital voice data in which the voice of the previous frame has been smoothly reduced.

Consequently, it is possible to smoothly reduce the voice output that is outputted from the speaker 801 before the sound breakup, due to under flow caused by a drop below the first threshold value of SP output buffer 501, occurs.

In the following, a situation in which the remaining data amount of SP output buffer 501 exceeds a second threshold value will be described. At the time when the remaining data amount of SP output buffer 501 exceeds a second threshold value, the insertion/disposal control unit 100 outputs a discard request to the selective disposal unit 200. As a result, the selective disposal unit 200 discards the voice data frame that is outputted from the voice decoder 401 conforming to ITU-T G.723.1. In this manner, the insertion/disposal control unit 100 does not allow the supply of digital voice data to occur until the data amount of SP output buffer 501 drops below the second threshold value.

In the aforementioned, the first embodiment of the present invention has been described in detail with reference to the figures. However, the concrete structures are not limited to this embodiment, and design modifications are possible within the scope of the present invention, as long as they do not deviate from the essential elements of the present invention.

Figure 2:
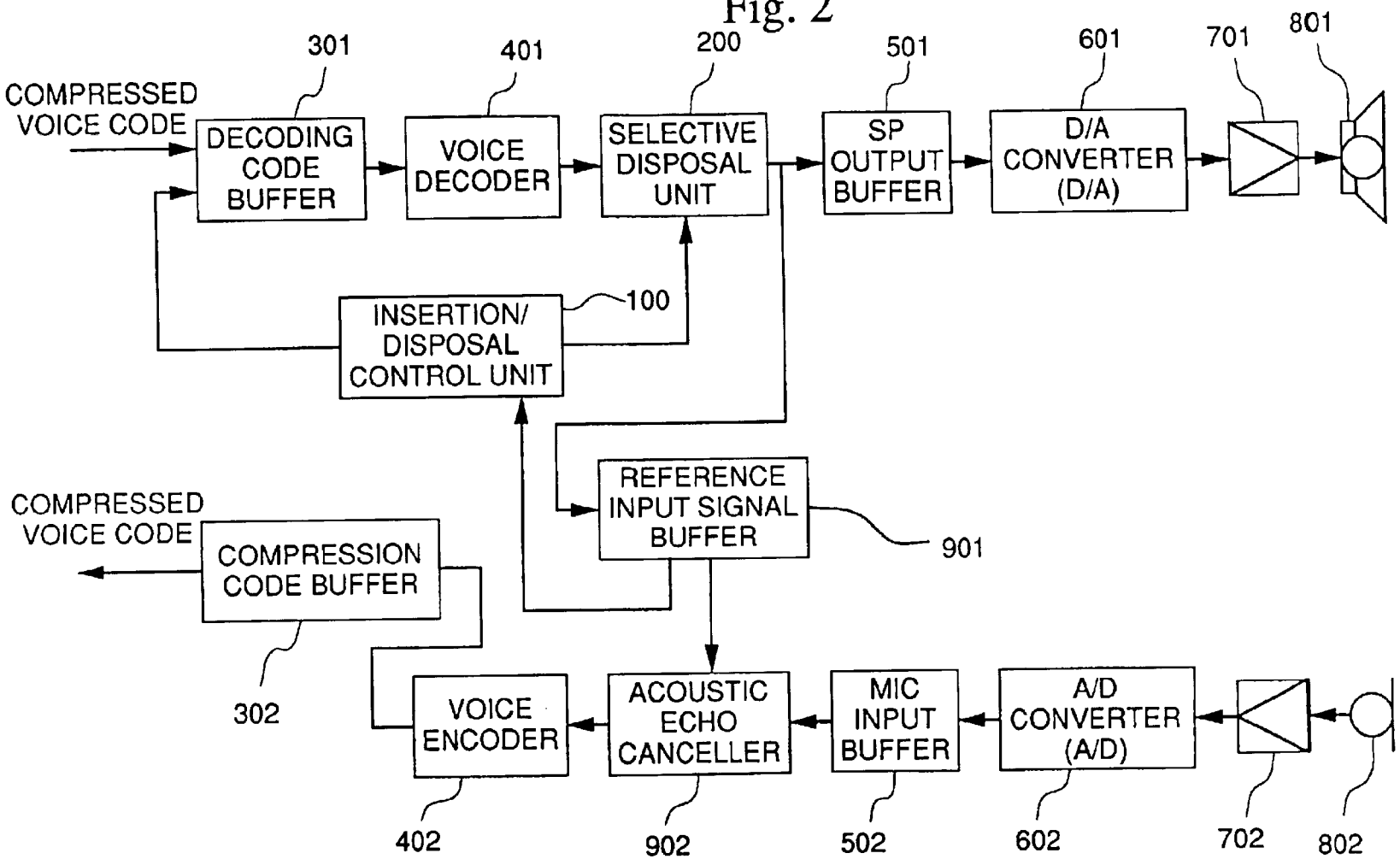
FIG. 2 is a block diagram showing the structure of a voice transceiver according to a second embodiment of the present invention.
Figure 3:
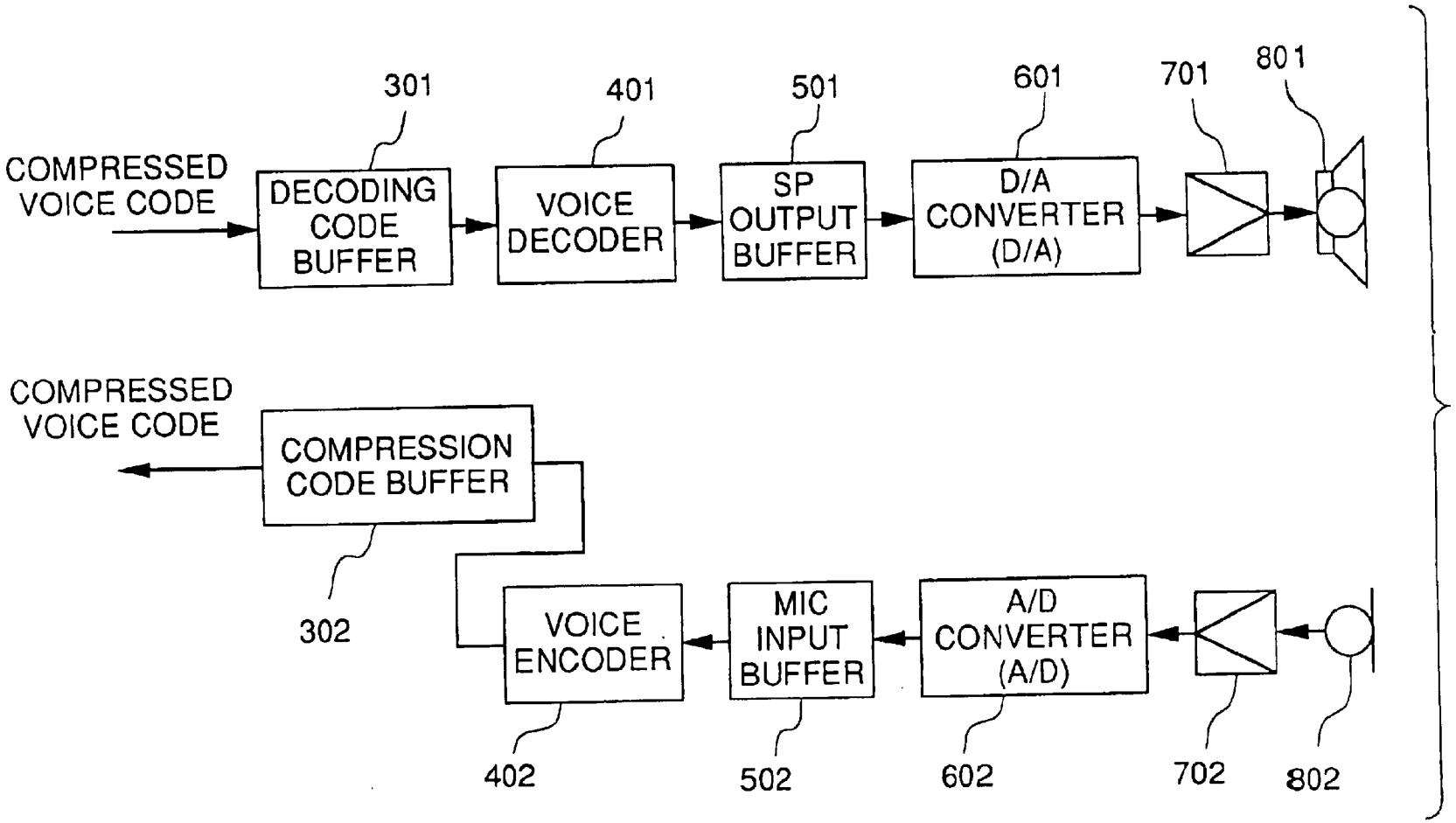
Fig. 3 RELATED ART
FIG. 3 is a block diagram showing the structure of a conventional example of a voice transceiver.

For example, a second embodiment of the present invention will be described with reference to FIG. 2. FIG. 2 is a block diagram showing the structure of a voice transceiver according to a second embodiment.

In the figure, a decoding code buffer 301 receives a compressed voice code received from the circuit side (not shown in the figure), and stores this code into an internal memory portion therein. The voice decoder 401 expands the compressed voice code inputted from decoding code buffer 301 into digitalized digital voice data. A selective disposal unit 200 is provided for selectively discarding digital voice data inputted from the voice decoder 401.

SP output buffer 501 stores the digital voice data that has been expanded by means of the voice decoder 401, but has not been discarded by the selective disposal unit 200. Data which is identical to that supplied to the SP output buffer 501 is then supplied and stored in a reference input signal buffer 901. The insertion/disposal control unit 100 monitors the remaining data amount of the digital voice data stored in the reference input signal buffer 901, and respectively supplies a dummy voice code to the decoding code buffer 301, and a discard request signal to the selective disposal unit 200.

D/A converter 601 converts the digital voice data of SP output buffer 501 into an analog voice signal. An amplifier 701 amplifies the analog voice signal inputted from the D/A converter 601. A speaker 801 then emits the amplified analog voice signal into the air.

A microphone 802 is provided for collecting and converting a transmitted voice into an analog voice input signal. An amplifier 702 amplifies the analog voice input signal that is inputted from the microphone 802. A/D converter 602 converts the analog voice input signal that is inputted from amplifier 702 into a digital input signal. MIC input buffer 502 then stores the digitalized digital input signal.

An acoustic echo canceller 902 suppresses the acoustic echo component in the digital input signal. In addition, a voice encoder 402 encodes the digital voice output signal that is outputted from the acoustic echo canceller 902, and outputs the results as a compressed voice code. Additionally, a compression code buffer 302 stores the compressed voice code outputted from the voice encoder 402.

In the following, an operational example of the voice transceiver according to the aforementioned second embodiment will be described with reference to FIG. 2.

When a compressed voice code is received, for example, from the communication circuit side (not shown in the figure), the decoding code buffer 301 temporarily stores this compressed voice code into an internal memory portion therein. Using the writing of the compressed voice code into the aforementioned decoding code buffer 301 as a trigger, a voice decoder 401 then expands the compressed voice code stored in the memory portion of the decoding code buffer 301, and generates digitalized digital voice data.

Subsequently, the voice decoder 401 outputs the generated digital voice data to a selective disposal unit 200. If the selective disposal unit 200 has not received a discard request signal from the insertion/disposal control unit 100, then the selective disposal unit 200 respectively outputs the supplied digital voice data to SP output buffer 501 and reference input signal buffer 901.

On the other hand, if the selective disposal unit 200 has received a discard request from the insertion/disposal control unit 100, then the corresponding digital voice data supplied thereto is discarded, and this digital voice data is not outputted to SP output buffer 501 or reference input signal buffer 901. In this manner, SP output buffer 501 and reference input signal buffer 901 store the digital voice data supplied from the selective disposal unit 200.

Subsequently, an acoustic echo canceller 902 references the digital voice data stored in the reference input signal buffer 901, and suppresses the echo component in the digital input signal. The digital voice data of the SP output buffer 501 is then retrieved one sample at a time, as necessary, converted into an analog voice signal in D/A converter 601, and emitted from a speaker 801 after being passing through an amplifier 701.

On the other hand, an analog voice signal inputted from a microphone 802 undergoes sampling, as necessary, by means of A/D converter 602 via amplifier 702. The sampled analog voice signal is then converted into digital input data, and written into MIC input buffer 502. The acoustic echo canceller 902 suppresses the echo component from the digital input data of MIC input buffer 502, and supplies the result to the voice encoder 402.

The voice encoder 402 then encodes the digital input data that is outputted from acoustic echo canceller 902, and writes the encoded and compressed voice code into a compression code buffer 302. The compressed voice code of the aforementioned compression code buffer 302 is then transferred to the communication circuit side (not shown in the figure).

In addition, the insertion/disposal control unit 100 monitors the remaining data amount of the digital voice data stored in the reference input signal buffer 901, and when this amount falls below a previously set first threshold value, outputs a dummy voice code to the decoding code buffer 301. Thereafter, the supply of the dummy voice code serves as a trigger by means of which the operation for generating the aforementioned SP output voice is started. The voice data accumulates in the reference input signal buffer 901 until the data amount stored in this signal buffer 901 exceeds the aforementioned first threshold value.

On the other hand, the insertion/disposal control unit 100 monitors the remaining data in reference input signal buffer 901, and when the remaining data amount exceeds a second threshold value, the insertion/disposal control unit 100 issues a discard request to the selective disposal unit 200. As a result, the selective disposal unit 200 conducts the discard (disposal) processing of the digital voice data with regard to which it has received a discard request, wherein the supply of voice data is not conducted until the data amount drops below the second threshold value of the reference input signal buffer 901.

Therefore, as a result of the aforementioned, the voice transceiver according to both the first and second embodiments monitors the data amount of the digital voice data stored in SP output buffer 501, and performs insertion/disposal controls of this digital voice data. Thus, an effect is obtained that it is possible to smoothly output an output voice from a speaker unit without the occurrence of breakup in the output voice.

Furthermore, according to the voice transceiver of the second embodiment, the operation of an acoustic echo canceller 902 provides the additional effects of stability, since the contents of the output voice of the actual speaker 801 and those of the reference input signal buffer 901 are always in agreement, by means of the insertion/disposal control unit 100 which monitors the digital voice data stored in reference input signal buffer 901, and performs the insertion/disposal control of this voice data.

According to a first aspect of the present invention, a voice transceiver is provided which is characterized in comprising: an input means for inputting compressed voice codes of analog data; an expansion means for digitalizing said compressed voice codes, and expanding and outputting said digital voice data; a buffer means for storing said digital voice data; a detection means for detecting the quantity of data of said digital voice data stored in said buffer, and outputting a detection signal as a detection result; a conversion means for converting said digital voice data into analog voice data based on said detection signal; and a speaker means for emitting said analog voice data into the air. Therefore, the data amount of the digital voice data stored in said buffer means is monitored, and insertion control of the digital voice data is performed, such that it is possible to smoothly output an output voice from a speaker unit without the occurrence of breakup in the output voice.

According to a second aspect of the present invention, a voice transceiver is provided which is characterized in further comprising a data control means for controlling the output of said digital voice data to said conversion means, based on said detection signal; wherein, said data control means outputs a dummy code to said expansion means, in the case when said digital voice data stored in said buffer means is less than a required amount for play back; in contrast, in the case when said buffer means approaches an overflow amount, said data control means does not allow the output of said digital voice data to said conversion means. As a result, the remaining data amount of the digital voice data stored in said buffer means is monitored, and insertion/disposal control of the digital voice data to the conversion means is performed, such that it is possible to smoothly output an output voice from the actual speaker unit without the occurrence of breakup in the output voice. In addition, the delay can be maintained below a fixed level, since the delays (amounts) from the time of voice input from the transmitting terminal to the speaker output at the "self" terminal do not accumulate.

According to a third aspect of the present invention, a voice transceiver is provided, wherein when said dummy code is inputted into said expansion means, said expansion means outputs digital voice data in which the strength of said compressed voice code inputted immediately prior to said dummy signal is reduced. As a result, the remaining data amount of the digital voice data stored in said buffer means is monitored, and insertion control of the voice data is performed, such that it is possible to smoothly output an output voice from the actual speaker unit without the occurrence of breakup in the output voice.

According to a fourth aspect of the present invention, a voice transceiver is provided which is characterized in further comprising: a microphone means for inputting voice data; a second conversion means for converting said voice data into a digital signal, and outputting this conversion result as other digital voice data; and an echo component removal means for removing the echo component contained in said other digital voice data. As a result, by means of monitoring the remaining data amount of the digital voice data stored in said buffer means of said detection means, and performing insertion/disposal control of the voice data, said echo component removal means provides the additional effects of stability since the contents of the output voice of the actual speaker and those of the buffer means are always in agreement.

What is claimed is:

1. A voice transceiver comprising:

input means for receiving and temporarily storing compressed voice codes:

voice decoder means connected to and triggered by said input means for expanding the compressed voice codes and generating digitalized digital voice data:

selective disposal means receiving the generated digitalized digital voice data from the voice decoder means and responsive to a discard request for discarding the generated digitalized digital voice data when the discard request is present;

speaker output buffer means for receiving and temporarily storing digitalized digital voice data passed by said selective disposal means;

insertion/disposal control means connected to monitor data temporarily stored in said speaker output buffer means and, if an amount of data temporarily stored in said speaker output buffer means falls below a first threshold, outputting a dummy voice code to said input means, but if an amount of data temporarily stored in said speaker output buffer means rises above a second threshold, generating said discard request to said selective disposal means;

digital-to-analog converter means for converting the generated digitalized digital voice data temporarily stored in said speaker output buffer means to an analog voice signal;

a speaker connected to receive said analog voice signal and generating an acoustical output;

microphone means for inputting an acoustical voice input;

analog-to-digital conversion means for converting said voice input into converted digital voice data;

microphone buffer means for receiving and temporarily storing said converted digital voice data;

reference input signal buffer means for receiving and temporarily storing generated digitalized digital voice data passed by said selective disposal unit, said insertion/disposal control means being connected to said reference signal buffer means to thereby monitor data temporarily stored in said speaker output buffer means;

echo component removal means responsive to said reference input buffer means for suppressing an echo component contained in said converted digital voice data; and voice encoder means connected to receive converted digital voice data from which an echo component has been suppressed from said echo component removal means for encoding and compressing an output voice code.

2. The voice transceiver according to claim 1, wherein when said dummy code is input to said input means, said voice decoder means outputs digitalized digital voice data in which the strength of said compressed voice code inputted immediately prior to said dummy signal is reduced.

3. A voice transceiver comprising:

input means for receiving and temporarily storing compressed voice codes;

voice decoder means connected to and triggered by said input means for expanding the compressed voice codes and generating digitalized digital voice data;

selective disposal means receiving the generated digitalized digital voice data from the voice decoder means and responsive to a discard request for discarding the generated digitalized digital voice data when the discard request is present;

output buffer means for receiving and temporarily storing digitalized digital voice data passed by said selective disposal means;

insertion/disposal control means connected to monitor data temporarily stored in said output buffer means and, if an amount of data temporarily stored in said output buffer means falls below a first threshold, outputting a dummy voice code to said input means, but if an amount of data temporarily stored in said output buffer means rises above a second threshold, generating said discard request to said selective disposal means;

digital-to-analog converter means for converting the generated digitalized digital voice data temporarily stored in said output buffer means to an analog voice signal;

means for inputting an acoustical voice input;

analog-to-digital conversion means for converting said voice input into converted digital voice data;

buffer means for receiving and temporarily storing said converted digital voice data;

reference input signal buffer means for receiving and temporarily storing generated digitalized digital voice data passed by said selective disposal unit, said insertion/disposal control means being connected to said reference signal buffer means to thereby monitor data temporarily stored in said output buffer means;

echo component removal means responsive to said reference input buffer means for suppressing an echo component contained in said converted digital voice data; and voice encoder means connected to receive converted digital voice data from which an echo component has been suppressed from said echo component removal means for encoding and compressing an output voice code.

* * * * *